US006021963A

United States Patent [19]

Coldren et al.

[11] Patent Number: 6,021,963

[45] Date of Patent: Feb. 8, 2000

[54] CARTRIDGE CONTROL VALVE WITH TOP MOUNTED SOLENOID AND FLAT VALVE SEAT FOR A FUEL INJECTOR

[75] Inventors: Dana R. Coldren, Fairbury, Ill.; Charles D. Ellenbecker, Manhattan, Kans.; Ching W. Jaw, Phoenix, Ariz.

[73] Assignee: Caterpillar Inc., Peoria, Ill.

[21] Appl. No.: 09/075,899

[22] Filed: May 11, 1998

Related U.S. Application Data

[60] Provisional application No. 60/068,651, Dec. 23, 1997.

[51] Int. Cl.[7] ..... B05B 1/30; F02M 47/02

[52] U.S. Cl. ..... 239/585.1; 239/88; 239/95; 239/585.3

[58] Field of Search ..... 239/88, 89, 90, 239/91, 92, 93, 95, 96, 585.1, 585.3

[56] References Cited

U.S. PATENT DOCUMENTS

| | | | |
|---|---|---|---|
| 2,812,776 | 11/1957 | Lofftus et al. | 137/625.27 |
| 3,325,139 | 6/1967 | Diener et al. | 251/129 |
| 3,446,474 | 5/1969 | Diver | 251/141 |
| 3,531,080 | 9/1970 | Dillon | 251/377 |
| 3,771,760 | 11/1973 | Sheldon et al. | 251/75 |
| 4,618,095 | 10/1986 | Spoolstra | 239/90 |
| 4,678,000 | 7/1987 | Kushida | 137/1 |
| 4,717,118 | 1/1988 | Potter | 251/129.02 |
| 4,834,141 | 5/1989 | Frisch | 137/625.66 |
| 4,869,462 | 9/1989 | Logie et al. | 251/129.16 |
| 4,941,447 | 7/1990 | Mannhardt | 123/455 |
| 5,082,180 | 1/1992 | Kubo et al. | 239/88 |
| 5,109,885 | 5/1992 | Tauscher | 137/554 |
| 5,121,730 | 6/1992 | Ausman et al. | 123/467 |
| 5,131,624 | 7/1992 | Kreuter et al. | 251/129.18 |
| 5,241,935 | 9/1993 | Beck et al. | 123/300 |
| 5,341,783 | 8/1994 | Beck et al. | 123/446 |
| 5,375,576 | 12/1994 | Ausman et al. | 123/446 |
| 5,407,131 | 4/1995 | Maley et al. | 239/90 |
| 5,474,234 | 12/1995 | Maley | 239/88 |
| 5,494,219 | 2/1996 | Maley et al. | 239/88 |
| 5,524,825 | 6/1996 | Ueda | 239/88 |
| 5,605,289 | 2/1997 | Maley et al. | 239/585.1 |
| 5,865,373 | 2/1999 | Buckley et al. | 239/90 |

FOREIGN PATENT DOCUMENTS

| | | |
|---|---|---|
| 857 723 | 7/1949 | Germany . |
| 23 39 209 | 8/1973 | Germany . |

*Primary Examiner*—Andres Kashnikow
*Assistant Examiner*—Robin O. Evans
*Attorney, Agent, or Firm*—Michael McNeil

[57] ABSTRACT

A cartridge control valve includes a valve body that defines an inlet passage separated from an outlet passage by a flat valve seat. A solenoid is attached to the valve body. A valve member has one end positioned in the valve body and an other end attached to the solenoid. The valve member has an annular knife edge valve surface located between the one end and the other end. The valve member is moveable from a first position to a second position by energizing the solenoid. The annular knife edge surface is away from the flat valve seat to open the inlet passage to the outlet passage when the valve member is in one of its first position and its second position. The annular knife edge valve surface is seated against the flat valve seat to close the inlet passage to the outlet passage when the valve member is in the other of its first position and its second position.

12 Claims, 3 Drawing Sheets

CARTRIDGE CONTROL VALVE WITH TOP MOUNTED SOLENOID AND FLAT VALVE SEAT FOR A FUEL INJECTOR

CROSS REFERENCE TO RELATED APPLICATIONS

This application is based, in part, on the material disclosed in U.S. provisional patent application Ser. No. 60/068651 filed Dec. 23, 1997.

TECHNICAL FIELD

The present invention relates generally to electronically controlled fuel injectors, and more particularly to control valves for fuel injectors.

BACKGROUND ART

Examples of electronically controlled cartridge control valves for fuel injectors are shown in U.S. Pat. No. 5,494,219 to Maley et al., U.S. Pat. No. 5,407,131 to Maley et al., U.S. Pat. No. 4,869,462 to Logie et al., and U.S. Pat. No. 4,717,118 to Potter. In each of these examples, the injector includes a mechanically actuated fuel pumping plunger and an electronically actuated fuel pressure control valve assembly. The pressure control valve assembly includes a solenoid operated poppet valve that controls fuel pressure in the injector in order to control fuel injection delivery. Fuel pressure is controllably enabled to be developed within the injector by electrical actuation of the pressure control valve assembly. Fuel pressure is controllably prevented from developing within the injector by not electrically actuating the pressure control valve so that fuel can spill through a return passage while the plunger is undergoing a portion of its pumping stroke.

In such electronically controlled fuel injectors, the armature of the pressure control valve assembly moves the poppet valve in one direction until it engages a valve seat, and holds the poppet valve in its closed position to enable fuel pressure to be developed in the injector, eventually resulting in fuel injection. At the end of the fuel injection cycle, the solenoid is de-energized, and a return spring moves the poppet valve member off the valve seat, returning the poppet valve member to its open position, which prevents the development of fuel pressure by spilling the fuel back to a fuel reservoir.

With reference to Maley et al. patents identified earlier, they achieved a break through in cartridge control valves through the use of a valve member with an annular knife edge that seats against a flat valve seat. The advantage of this knife edge/flat seat sealing is that less force is required to hold the valve closed at a given pressure and also opens with less force than the conically seated poppet valve members of the prior art. In addition, the flat seat design requires less valve member stroke movement than conventional conical valve seats to achieve a given flow area across the seat for a given valve member diameter. Although the Maley et al. control valves have achieved these advantages, there remains room for improvement. For example, the solenoid coil in Maley et al. '131 must be embedded within the valve body, which limits the size of the coil and the corresponding force it can produce. An innovation that permits the use of a larger coil in conjunction with the Maley et al. flat seating could further improve the control valves' performance. In addition, there remains room for improvement in decreasing the over all number of parts in the control valve assembly, as well as the ease with which those parts can be assembled in a production environment. Finally, any innovation that would decrease the number of valve components exposed to high pressure would also be an improvement since decreasing the number of components exposed to high pressure improves the robustness and the working life of the control valve.

The present invention is directed to improving upon cartridge control valves of the prior art.

DISCLOSURE OF THE INVENTION

In one embodiment, a control valve includes a valve body defining an inlet passage separated from an outlet passage by a flat valve seat. A solenoid is attached to the valve body. A valve member has one end positioned in the valve body and an other end attached to the solenoid. The valve member has an annular knife edge valve surface located between said one end and said other end. The valve member is moveable from a first position to a second position by energizing the solenoid. The annular knife edge valve surface moves away from the flat valve seat to open the inlet passage to the outlet passage when the valve member is in one of its first position and its second position. The annular knife edge valve surface is seated against the flat valve seat to close the inlet passage to the outlet passage when the valve member is in the other of its first position and its second position.

In another embodiment, the annular knife edge valve surface is away from the flat valve seat to open the inlet passage to the outlet passage when the valve member is in its first position. The annular knife edge valve surface is seated against the flat valve seat to close the inlet passage to the outlet passage when the valve member is in its second position. Finally, a compression spring is positioned in the valve body and operable to bias the valve member toward its first position.

In still another embodiment of the present invention, a fuel injector includes an injector body that defines a nozzle outlet and a cartridge opening, and further defines a spill passage and a return passage that open into the cartridge opening. A cartridge control valve having a valve body is received in the cartridge opening and attached to the injector body. The valve body defines an inlet passage separated from an outlet passage by a flat valve seat. The inlet passage opens to the spill passage, and the outlet passage opens to the return passage. A solenoid is attached to the valve body. A valve member has one end positioned in the valve body and an opposite end attached to the solenoid. The valve member has an annular knife edge valve surface between the one end and the opposite end. The valve member is moveable from a first position to a second position by energizing the solenoid. The annular knife edge valve surface is away from the flat valve seat to open the inlet passage to the outlet passage when the valve member is in one of its first position and its second position. The annular knife edge valve surface is seated against the flat valve seat to close the inlet passage to the outlet passage when the valve member is in the other of its first position and its second position.

BEST MODE FOR CARRYING OUT THE INVENTION

Figure 1:
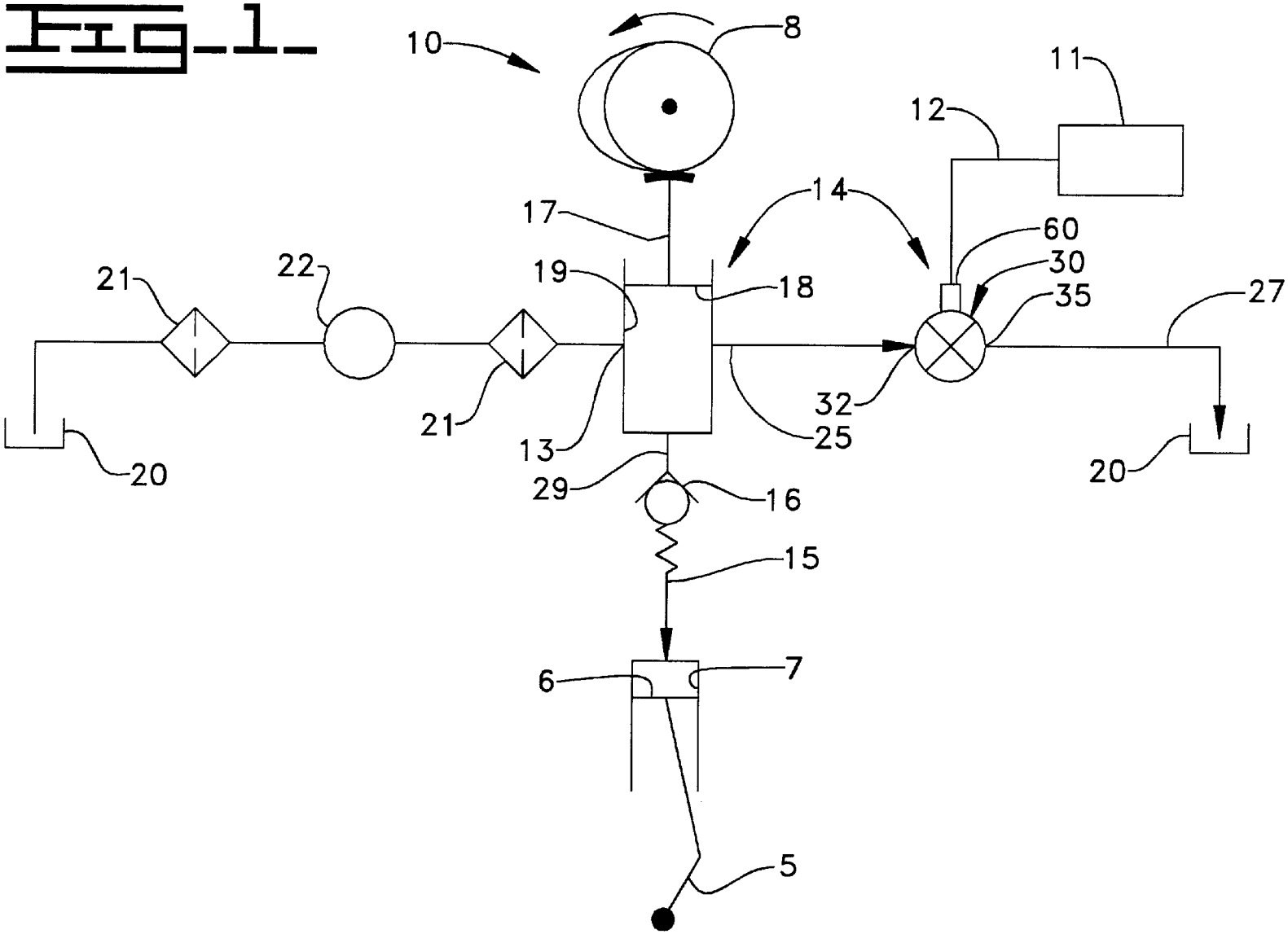
FIG. 1 is a schematic diagram illustrating a mechanically actuated electronically controlled fuel injection system.

In the drawings, the same reference numerals designate the same elements for features throughout all of the drawings.

Referring now to FIG. 1, there is illustrated an injector fuel system 10 adapted for a diesel-cycle direct-injection internal combustion engine having a number of engine pistons, only one of which is shown, i.e. piston 6. Each engine piston and corresponding engine cylinder would have a different fuel injector 14. Each engine piston 6 reciprocates in a separate cylinder 7 due to rotation of the engine cam shaft 5 in a conventional manner. Cam shaft 5 also rotates cam 8 which acts upon a tappet 17 of each injector 14 to mechanically actuate the injectors with each revolution of the engine.

Fuel injection system 10 includes a fuel source or tank 20. Fuel is drawn from fuel tank 20 by a relatively low pressure transfer pump 22, which carries the fuel through one or more fuel filters 21 to the fuel inlet 13 of each injector 14. With each revolution of cam 8, tappet 17 drives a pump piston 18 downward in pump chamber 19. Pump chamber 19 is connected to a spill passage 25 and a nozzle chamber 29 within injector 14. When fuel pressure within pumping chamber 19 is above a valve opening pressure, needle check valve 16 opens and fuel commences to spray into cylinder 7 through nozzle outlet 15. The fuel is prevented from reaching the valve opening pressure as long as spill passage 25 is open.

Spill passage 25 is connected to an inlet passage 32 of cartridge control valve 30. An outlet passage 35 from cartridge control valve 30 is connected to a return passage 27, which in turn is connected back to fuel tank 20 for recirculation. Fuel injection is controlled by opening and closing cartridge control valve 30 to open and close fluid communication between inlet passage 32 and outlet passage 35. This opening and closing of cartridge control valve 30 is controlled by a conventional electronic control module 11 that commands the energization or de-energization of a solenoid 60 via a communication line 12 in a conventional manner.

Figures 2, 4:
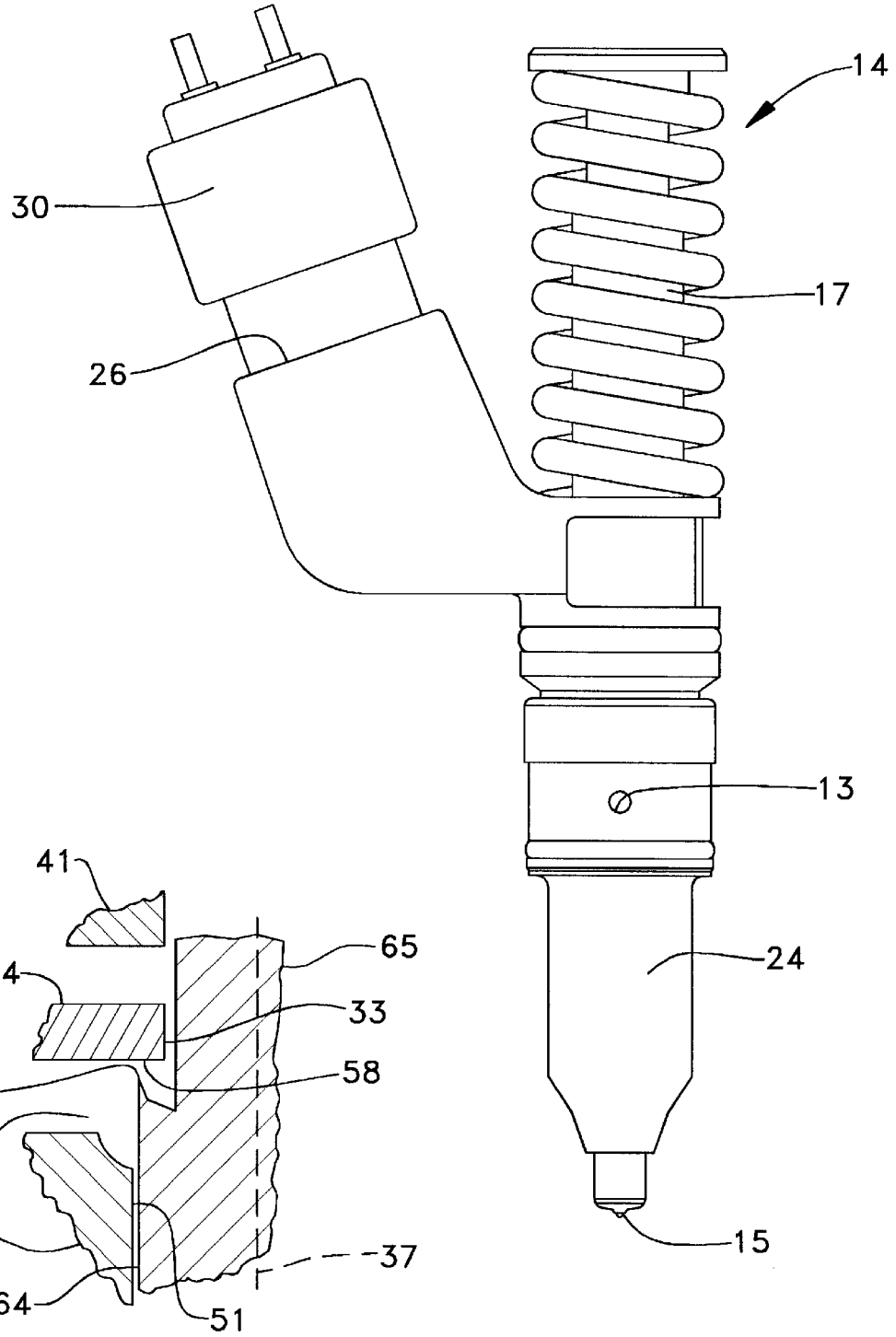
FIG. 2 is an elevational view of a fuel injector incorporating a cartridge control valve according to one embodiment of the present invention.
FIG. 4 is a fragmented sectional view illustrating a flat seat and knife edge valve surface in accordance with one aspect of the present invention.

Referring now to FIG. 2, an example injector 14 according to the present invention is illustrated. Fuel injector 14 includes an injector body 24, a fuel inlet 13, a nozzle outlet 15 and a cartridge opening 26 formed in injector body 24. A cartridge control valve 30 is received in cartridge opening 26 and attached to injector body 24.

Figure 3:
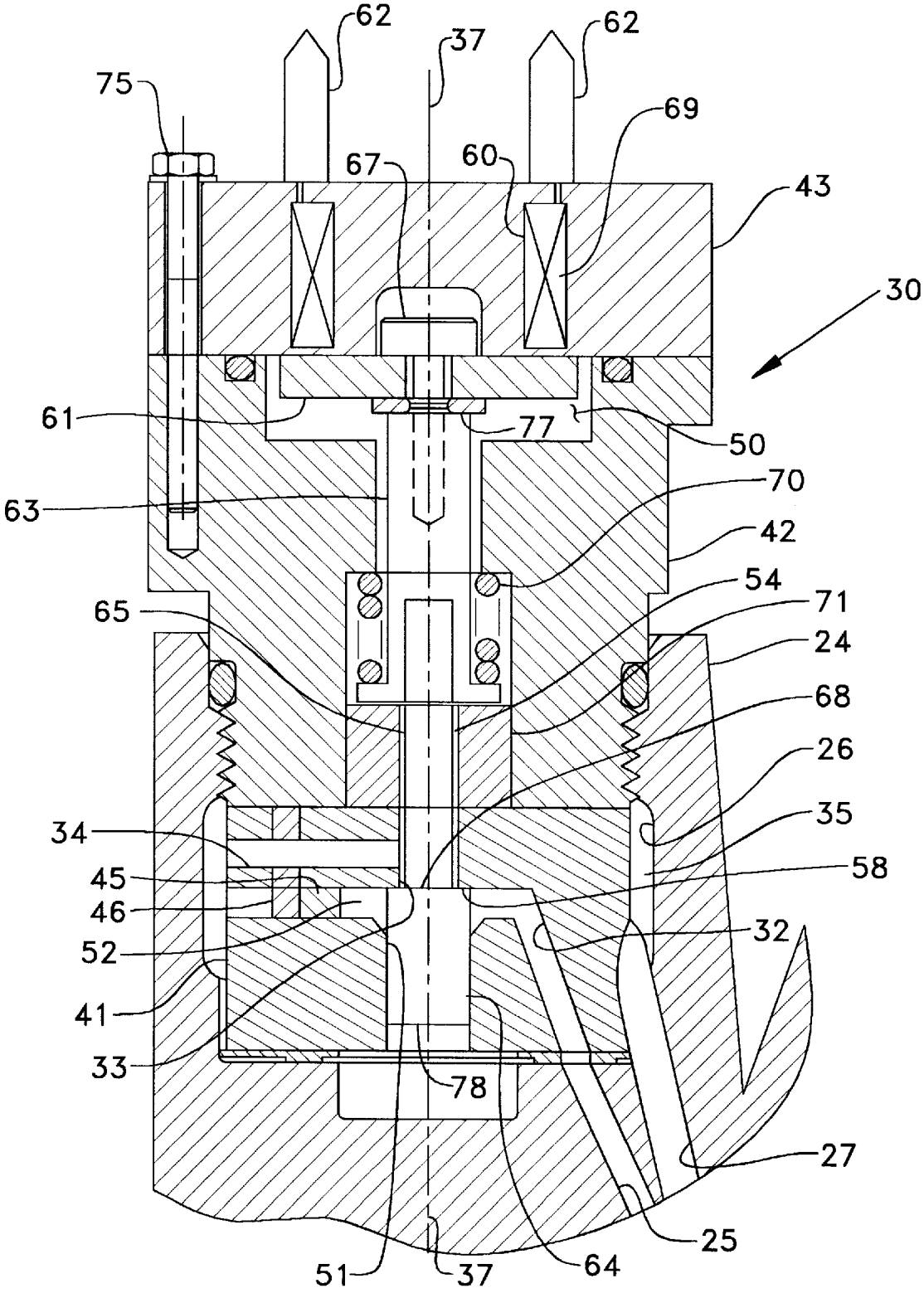
FIG. 3 is a sectioned side elevational view of a cartridge control valve according to the present invention.

Referring now to FIG. 3, the inner structure of cartridge control valve 30 is illustrated. Cartridge control valve 30 includes a valve body made up of a plurality of generally cylindrically shaped body components 42, 41 and 43 that are attached to one another in a manner well known in the art. In this case, valve body components 42 and 43 are held together by a plurality of fasteners, only one of which is shown, i.e. fastener 75. When control valve 30 is threaded into cartridge opening 26, valve body component 41 is held against the underside of valve body component 42. When cartridge control valve 30 is attached to injector body 24, its inlet passage 32 is connected to a spill passage 25, which is connected to the pump chamber within the injector as discussed earlier. Also, an annular outlet passage 35 is connected to a return passage 27. A poppet valve member 65 is mounted within the valve body and reciprocates between an open position in which annular outlet passage 35 is open to inlet passage 32 via a vertical outlet passage 33 and a plurality of horizontal outlet passages 34, only one of which is shown. Poppet valve member 65 can also be moved to a closed position in which inlet passage 32 is closed to annular outlet passage 35 by energizing solenoid 60.

The various body components of cartridge control valve 30 are preferably attached to one another in a way that seals against leakage of fuel out of cartridge control valve 30. The valve body defines a solenoid cavity 50 within which is mounted a solenoid 60. Solenoid 60 includes an armature 61 and a coil 69, and is connected to a power source via external electrical contacts 62 in a conventional manner. The upturned knife edge 68 allows armature 61 to be positioned between coil 69 and valve member 65, along centerline 37. Poppet valve member 65 is attached at one end 77 to armature 61 of solenoid 60 via a conventional screw 67. The other end 78 of poppet valve member 65 moves in guide bore 51. In this example embodiment, poppet valve member 65 includes an upper portion 63 that is attached to a lower portion 64 through a conventional threaded attachment. The two part poppet valve member eases the manufacture and assembly of the same. A metering passage 54 extends between solenoid cavity 50 and annular outlet passage 35 so that solenoid cavity 50 is wetted but is sealed against leakage to the outside of cartridge control valve 30 in a conventional manner, such as by using o-rings, etc.

A return spring 70 normally biases poppet valve member 65 downward to its open position. The downward force of return spring 70 can be trimmed during manufacture of cartridge control valve 30 through the use of a trimming spacer (not shown) in a conventional manner. A travel spacer 71 sets the travel distance of poppet valve member 65 in a conventional manner.

Referring now also to FIG. 4, valve body component 41 is machined to include a relatively flat annular seating surface 58 that defines a portion of a spill cavity 52. High pressure plugs 45 and 46 are inserted into passageways within valve body component 41 in order to seal high pressure spill cavity 52 from leakage, in a conventional manner. Poppet valve member 65 is machined to include an annular knife edge 68 positioned between its opposite ends that closes spill cavity 52 to vertical passage 33 when seated against flat valve seat 58. Thus, return spring 70 normally biases annular knife edge 68 away from flat seating surface 58 as shown in FIG. 4; however, when solenoid 60 is energized, poppet valve member 65 is pulled upward to seat annular knife edge 68 against flat seating surface 58 to close fluid communication between inlet passage 32 and outlet passages 33,34 and 35. Poppet valve member 65 is guided in its movement by sizing part of lower portion 64 to slidably fit within a close tolerance within guide bore 51 made in valve body component 41. Poppet valve member 65 is preferably hydraulically balanced such that, except for fluid pressure gradients, the only forces acting on poppet valve member 65 should originate from solenoid 60 and return spring 70.

INDUSTRIAL APPLICABILITY

The present invention finds potential application in any solenoid actuated control valve. The control valve of the present invention is especially applicable for use with electronically controlled fuel injectors that control injection timing and mass flow through the controlled spillage of fuel using a control valve. The present invention is particularly suited as a cartridge control valve for the mechanically actuated electronically controlled fuel injectors of the type manufactured by Caterpillar, Inc. of Peoria, Ill.

Because the present invention can employ a top mounted E-frame type solenoid, there is more room available for a larger coil. This in turn permits the solenoid to produce a larger magnetic force to produce faster action in the poppet valve member. The top mounted solenoid of the present invention also decreases the complexity of electrical plumbing necessary to connect the solenoid to an external power source, since no internal electrical connections and wiring through the internal portions of the valve body is necessary. This in turn not only decreases the over all number of parts in the control valve but also improves the robustness and working life of the same. The present invention also includes the advantage of utilizing only a single high pressure valve body component 41 in conjunction with a flat seat, whereas prior art valves often require two valve body components held together in a sealing arrangement in the high pressure areas within the valve body.

Those skilled in the art will appreciate that numerous modifications and alternative embodiments of the present invention will be apparent in view of the foregoing description. Accordingly, this description is to be construed as illustrative only and is for the purpose of teaching those skilled in the art the best mode of carrying out the invention. The details of the structure may be varied substantially without departing from the spirit of the invention, the scope of which is defined in terms of the claims as set forth below.

We claim:

1. A control valve comprising:

a valve body defining an inlet passage separated from an outlet passage by a flat valve seat;

a solenoid attached to said valve body;

a valve member having one end positioned in said valve body and an other end attached to said solenoid, and having an annular knife edge valve surface located between said one end and said other end;

said valve member being movable from a first position to a second position by energizing said solenoid;

said annular knife edge valve surface being away from said flat valve seat to open said inlet passage to said outlet passage when said valve member is in one of said first position and said second position; and said annular knife edge valve surface being seated against said flat valve seat to close said inlet passage to said outlet passage when said valve member is in the other of said first position and said second position.

2. The control valve of claim 1 further comprising a compression spring positioned in said valve body and operable to bias said valve member toward said first position.

3. The control valve of claim 1 wherein said valve body has a centerline;

said solenoid includes a coil and an armature; and said armature is positioned between said coil and said valve member along said centerline.

4. The control valve of claim 1 wherein said annular knife edge valve surface is away from said flat valve seat to open said inlet passage to said outlet passage when said valve member is in said first position; and said annular knife edge valve surface is seated against said flat valve seat to close said inlet passage to said outlet passage when said valve member is in said second position.

5. The control valve of claim 1 wherein said valve body defines a guide bore; and said one end of said valve member moves in said guide bore.

6. A control valve comprising:

a valve body defining a guide bore and an inlet passage separated from an outlet passage by a flat valve seat;

a solenoid attached to said valve body;

a valve member having one end positioned in guide bore of said valve body and an other end attached to said solenoid, and having an annular knife edge valve surface located between said one end and said other end;

said valve member being movable from a first position to a second position by energizing said solenoid;

said annular knife edge valve surface being away from said flat valve seat to open said inlet passage to said outlet passage when said valve member is in said first position;

said annular knife edge valve surface being seated against said flat valve seat to close said inlet passage to said outlet passage when said valve member is in said second position; and a compression spring positioned in said valve body and operable to bias said valve member toward said first position.

7. The control valve of claim 6 wherein said valve body has a centerline;

said solenoid includes a coil and an armature; and said armature is positioned between said coil and said valve member along said centerline.

8. A fuel injector comprising;

an injector body defining a nozzle outlet and a cartridge opening, and further defining a spill passage and a return passage that open into said cartridge opening;

a cartridge control valve with a valve body and being received in said cartridge opening and attached to said injector body;

said valve body defining an inlet passage separated from an outlet passage by a flat valve seat, and said inlet passage opening to said spill passage, and said outlet passage opening to said return passage;

a solenoid attached to said valve body;

a valve member with one end positioned in said valve body and an opposite end attached to said solenoid, and having an annular knife edge valve surface between said one end and said opposite end;

said valve member being movable from a first position to a second position by energizing said solenoid;

said annular knife edge valve surface being away from said flat valve seat to open said inlet passage to said outlet passage when said valve member is in one of said first position and said second position; and said annular knife edge valve surface being seated against said flat valve seat to close said inlet passage to said outlet passage when said valve member is in the other of said first position and said second position.

9. The control valve of claim 8 further comprising a compression spring positioned in said valve body and operable to bias said valve member toward said first position.

10. The control valve of claim 9 wherein said valve body has a centerline;

said solenoid includes a coil and an armature; and said armature is positioned between said coil and said valve member along said centerline.

11. The control valve of claim 10 wherein said annular knife edge valve surface is away from said flat valve seat to open said inlet passage to said outlet passage when said valve member is in said first position; and said annular knife edge valve surface is seated against said flat valve seat to close said inlet passage to said outlet passage when said valve member is in said second position.

12. The control valve of claim 11 wherein said valve body defines a guide bore; and said one end of said valve member moves in said guide bore.

* * * * *